US006158255A

United States Patent [19]

Ternon

[11] Patent Number: 6,158,255

[45] Date of Patent: Dec. 12, 2000

[54] LOOP FABRIC WITH INTERLACED CHAIN STITCHES

[75] Inventor: Gerard Lucien Roger Ternon, Bolbec, France

[73] Assignee: Milliken & Company, Spartanburg, S.C.

[21] Appl. No.: 09/363,462

[22] Filed: Jul. 29, 1999

[51] Int. Cl.[7] ..... D04B 23/08; D04B 23/10; D03D 3/00

[52] U.S. Cl. ..... 66/194; 66/193; 66/195; 442/319

[58] Field of Search ..... 66/194, 193, 195, 66/191, 192; 442/315, 319

[56] References Cited

U.S. PATENT DOCUMENTS

| | | | |
|---|---|---|---|
| 3,603,117 | 9/1971 | Svoboda et al. | 66/193 |
| 4,705,710 | 11/1987 | Matsuda . | |
| 4,805,424 | 2/1989 | Charkovsky et al. | 66/194 |
| 4,838,044 | 6/1989 | Matsuda et al. . | |
| 4,858,447 | 8/1989 | Matsuda | 66/191 |
| 5,373,712 | 12/1994 | Yamamoto et al. . | |
| 5,440,902 | 8/1995 | Wieland et al. | 66/194 |
| 5,520,021 | 5/1996 | Clerici . | |
| 5,664,441 | 9/1997 | Clerici . | |
| 5,728,448 | 3/1998 | Okeya et al. | 66/192 |

FOREIGN PATENT DOCUMENTS

| | | |
|---|---|---|
| 2151220 | 1/1996 | Canada . |

*Primary Examiner*—Andy Falik
*Attorney, Agent, or Firm*—Terry T. Moyer; William S. Parks

[57] ABSTRACT

A warp knitted fabric having interlaced loops on the surface of the fabric. Each loop in each wale being interlaced with the loops on the adjacent wales. Such a fabric is suitable for use as part of a hook and loop attachment or fastening structure, although the fabric will find other uses and the invention is not limited to the use of the fabric as part of a hook and loop attachment. The loops on each wale are interlaced with the loops on each adjacent loops are formed from different yarns.

12 Claims, 5 Drawing Sheets

LOOP FABRIC WITH INTERLACED CHAIN STITCHES

This invention relates to a warp knitted fabric having interlaced loops on the surface of the fabric. Such a fabric is suitable for use as part of a hook and loop attachment or fastening structure, although the fabric will find other uses and the invention is not limited to the use of the fabric as part of a hook and loop attachment.

Typically, such fastening structures comprise both male and female components; the male component having a series of hooks, and the female component having a wale of corresponding loops, connectable to the hooks to enable fastening. The present invention is particularly concerned with the female component of the structure.

In our earlier International Patent Application No. PCT/EP97/05846 there is described a warp knit, weft inserted fabric which can be employed as the female component of a fastening structure. The fabric has a one to one correspondence between loops and stitches in the knit structure, and has a loop formed at each stitch of the background fabric. The loops can be formed using only a single loop bar. The individual wales of chain stitches are knitted on a supporting background, for example a knitted fabric, a film or other non-woven material. The loops of each wale are not interlaced with the loops from adjacent wales.

It is an object of the present invention to provide a fabric having all the advantages of that disclosed in PCT/EP97/05846 but with improved dimensional stability. It has been found that interlacing the loops of adjacent wales increases the dimensional stability and produces a lightweight fabric which may be knitted on a simple supporting structure, such as plain weft yarns, and may be cut afterwards while keeping its shape.

According to a first aspect of the present invention there is provided a fabric for use as a female member of a hook and loop fastening structure, the fabric comprising a plurality of individual wales of chain stitches, each of said chain stitches having a corresponding loop adapted to serve as the loop of said hook and loop fastening structure, wherein the wales of chain stitches are knitted on a supporting background, and wherein the loops on each wale are interlaced with the loops on each adjacent wale.

Preferably, each wale is made of two yarns.

Optionally, the background structure may be a regular warp knitted fabric. Alternatively, it may be a weft insertion warp knitted fabric. Alternatively, it may comprise a plurality of weft yarns on which the wales are knitted.

A further alternative is that the support background may be of a non-woven material or a film material. According to a second aspect of the present invention there is provided a method for producing a female component of a hook and loop fastening structure as described above wherein the loops are formed using a single guide bar.

Preferably, the pattern wheel of the knitting machine is set such that each wale has a movement of at least 4, most preferably at least 5 needles. Preferably the point diagram uses a stitch notation of 1-0/b-a or 0-1/a-b, where a is 4 or more, most preferably 5 or more, and b=a−1.

In order to portray a better understanding of the intended invention, embodiments will now be described, by way of example only, with reference to the accompanying figures in which.

Figure 4:
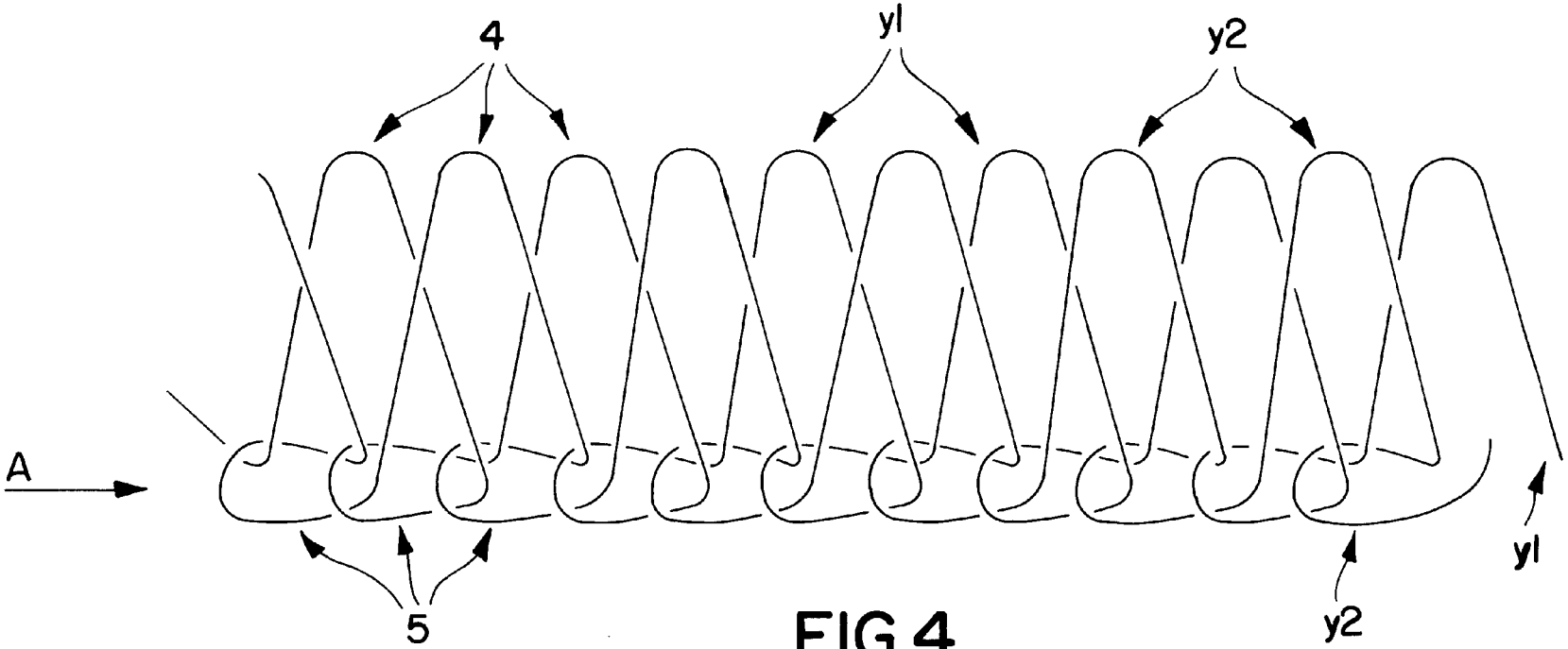
FIG. 4 is a schematic representation of a wale similar to that of FIG. 1 but having larger loops.
Figure 7:
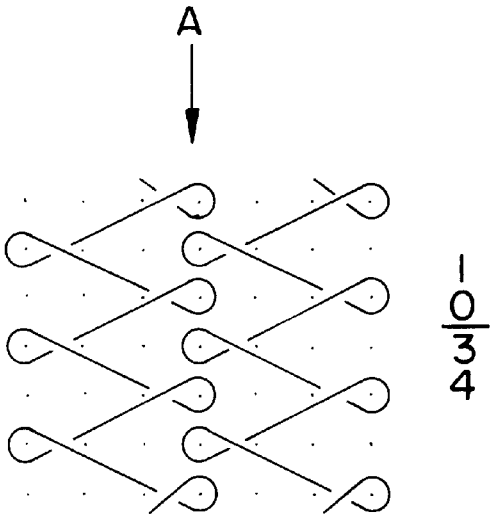
Figure 8:
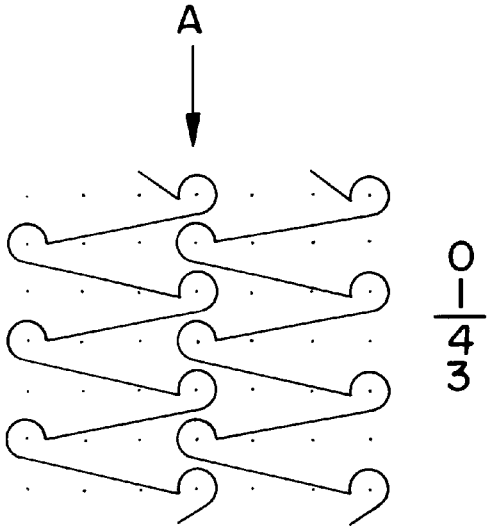
Figure 9:
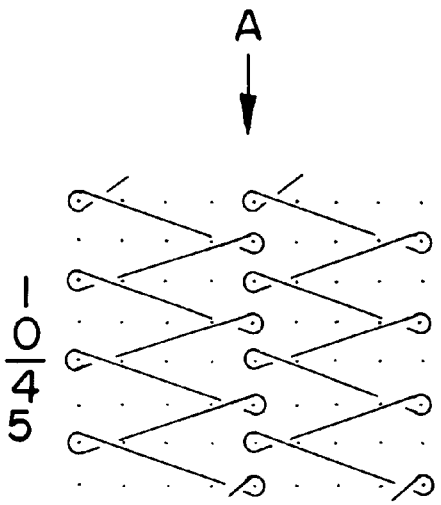
Figure 10:
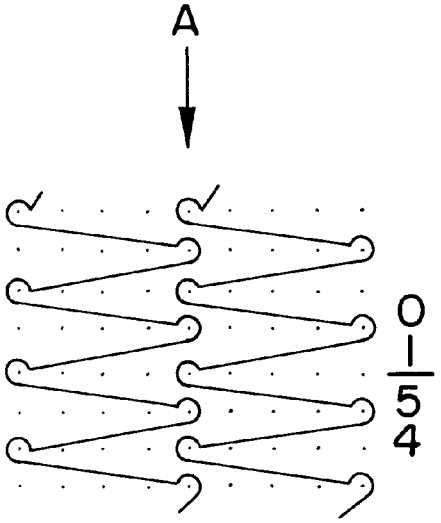
Figure 11:
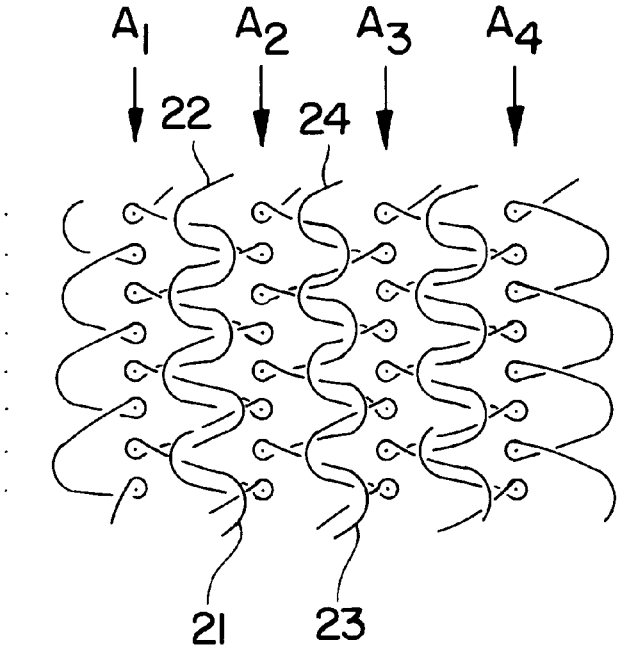

Similarly,

FIGS. 7 and 8 are point diagrams of the action of a guide bar of a knitting machine to produce the embodiment of FIG. 4;

FIGS. 9 and 10 are alternative point diagrams of the action of a guide bar of a knitting machine to produce the embodiment of FIG. 4; and FIG. 11 is a schematic representation of a fabric according to the invention comprising a number of interlaced individual wales of chain stitches.

Referring firstly to FIGS. 1 to 4, chain stitches 5 on a wale 1 are each associated with respective loops 4. The loops 4 are upstanding and provide a female connecting means to a male member comprising engageable hooks (not shown). The loops are made from two different yarns Y1, Y2, typically polyester yarns, using a single guide bar. Other yarn types may be used.

Each loop 4 extends from two underlying chain stitches 5, and each chain stitch 5 has two loops 4 associated with it, so that there is a corresponding number of loops 4 to stitches 5.

Figure 2:
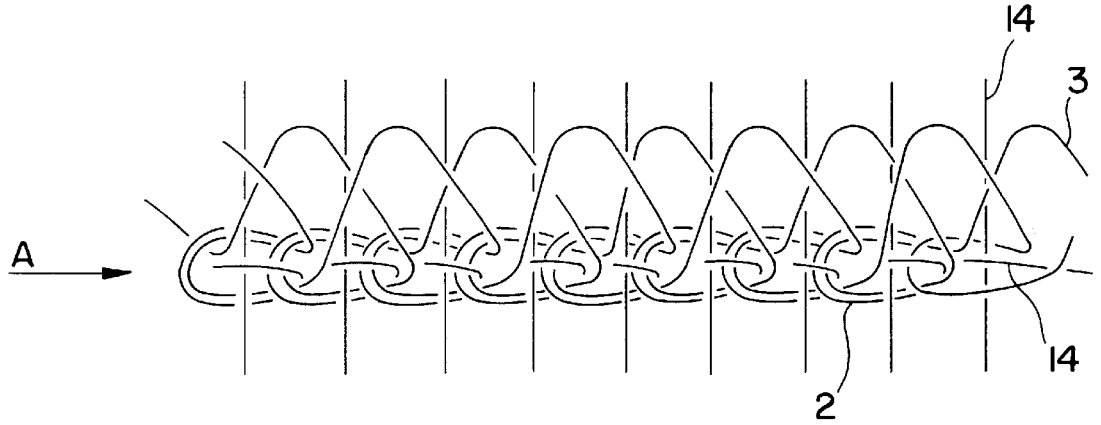
FIG. 2 is a schematic representation of the wale of FIG. 1 on a warp knitted fabric support structure.
Figure 3:
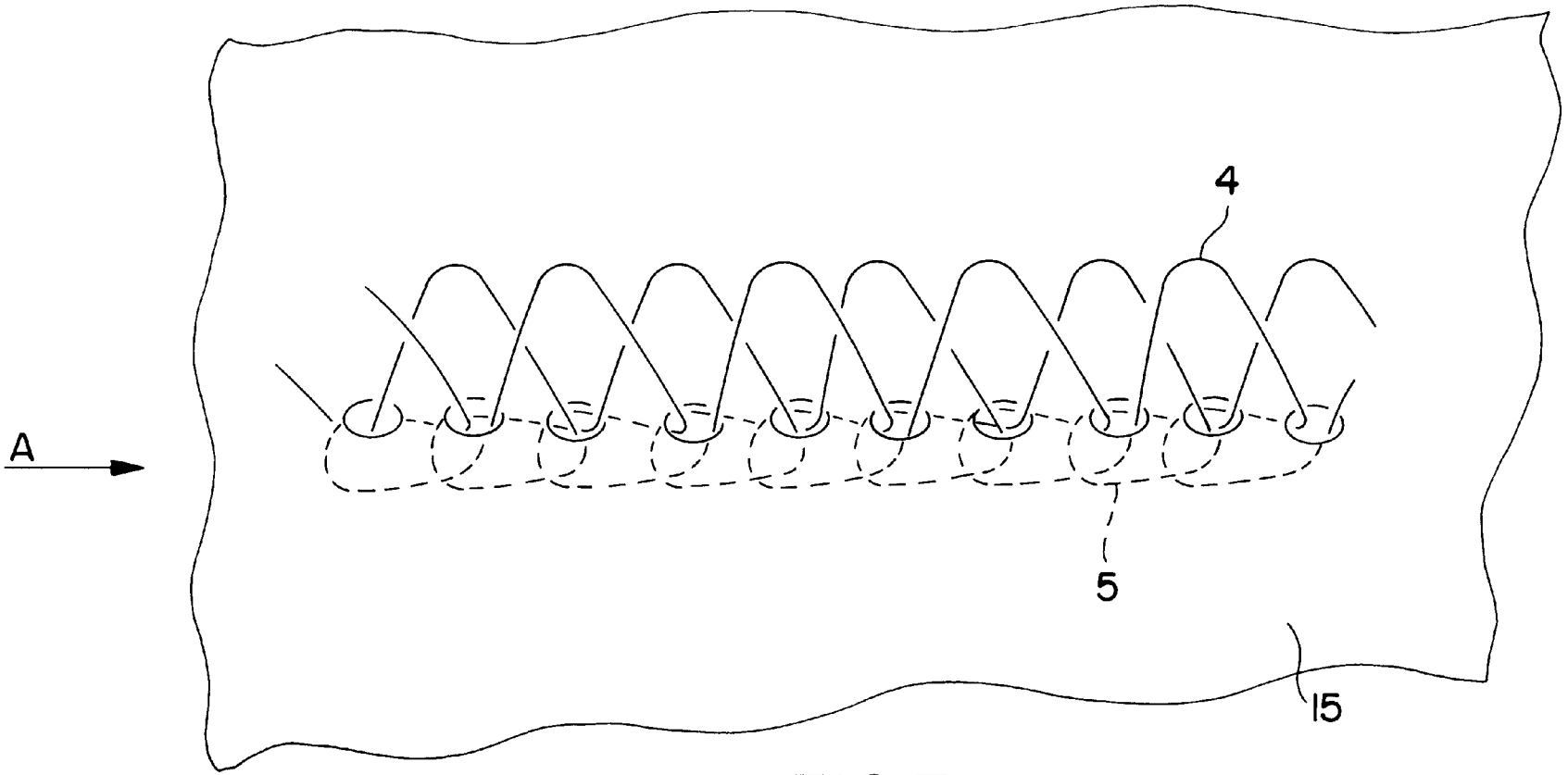
FIG. 3 is a schematic representation of the wale of FIG. 1 on a film support structure.

The wale, in use, is typically supported on a background, which may be a knitted fabric as referenced 14 in FIG. 2, or a film or other non-woven material as referenced 15 in FIG. 3.

Where a film or non-woven material is employed the wales are preferably stitched through the background material.

Figure 1:
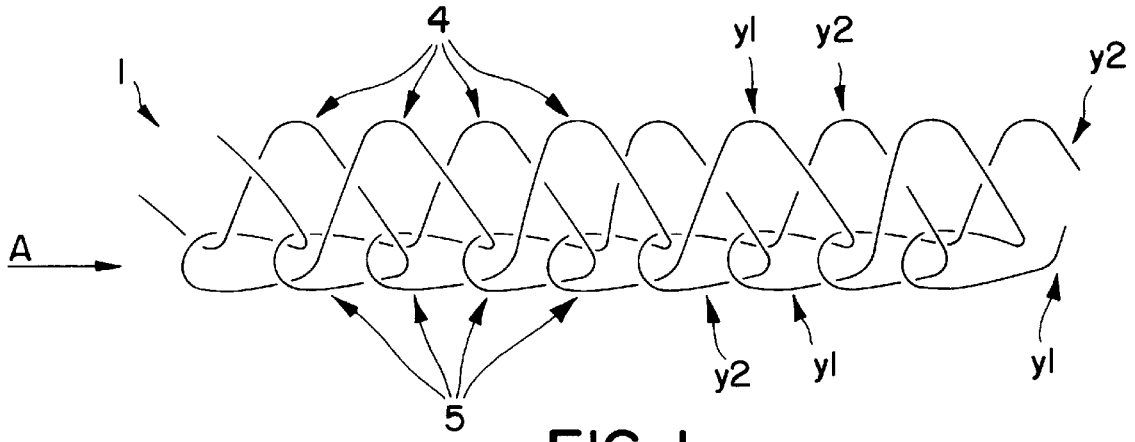
FIG. 1 is a schematic representation of an individual wale of chain stitches formed using two yarns.

Notably in FIG. 1 the loops 4 are made on the front side of the chain stitches 5.

Figure 5:
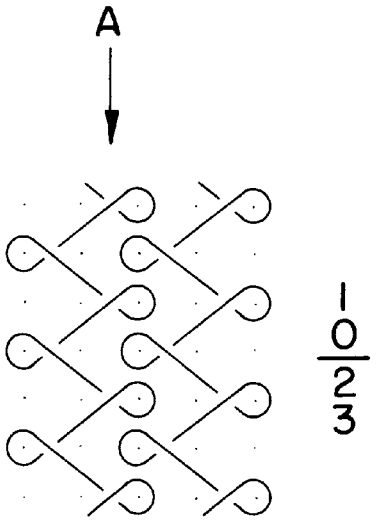
FIG. 5 is a point diagram of the action of the guide bar of a knitting machine to produce the embodiment of FIG. 1 with a closed stitch construction; the arrow A indicates the needle making the chain stitches 5 on FIG. 1.
Figure 6:
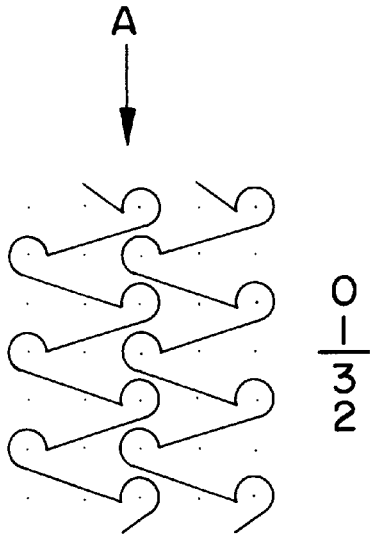
FIG. 6 is a point diagram of the action of the guide bar of a knitting machine to produce the embodiment of FIG. 1 with an opened stitch construction; the arrow A indicates the needle making the chain stitches 5 on FIG. 1.

FIGS. 5 and 6 demonstrate how either closed stitches or opened stitches may be used to form the wale shown in FIG. 1. In FIG. 5 the pattern wheel of the front bar of a knitting machine is set to knit a 1-0, 2-3 closed stitch. In FIG. 6 the pattern,wheel of the front bar of a knitting machine is set to knit a 0-1, 3-2 opened stitch.

For the two yarn loops shown in FIG. 4 it is possible to increase the height of the loops 4, that is by having a bigger movement between needles is shown in FIGS. 7 and 8. In FIG. 7 the pattern wheel is set to knit at 1-0/3-4 for closed stitches. In FIG. 8 the pattern wheel is set to knit at 0-1/4-3 for opened stitches.

A preferable support background for the embodiment of FIG. 1 is a weft insertion warp knitted fabric as shown in FIG. 2. In this embodiment another guide bar is used to add chain stitches without loops.

FIGS. 9 and 10 demonstrate how either closed stitches or opened stitches may be used to interlace the loops of the wales to achieve the interlaced fabric shown in FIG. 11. In FIG. 9 the pattern wheel of the front bar of a knitting machine is set to knit at 1-0, 4-5 to achieve closed stitches. In FIG. 10 the pattern wheel of the front bar of a knitting machine is set to knit at 0-1, 5-4 to achieve opened stitches.

With these two pattern wheel settings, a threading sequence of 2 in, 1 out is used. This threading sequence interlaces the loops on one wale with the loops of the adjacent wale, as shown in FIG. 11. The right side loops 21 on the wale A1 are interlaced with the left side loops 22 of the adjacent wale A2. The right side loops 23 on the wale A2 are interlaced with the left side loops 24 of the adjacent wale A3, and so on.

FIG. 11 shows the fabric with closed stitches, although the fabric may instead have open stitches.

The versions shown in FIGS. 9 and 10 can also be made with closed and opened stitches on the same pattern wheel without changing the interlacing of the loops.

In constructing the female component of the securing or attachment means, the guide bar preferably carries textured polyester, while the knitted support background yarn may be flat polyester. The weft insertion yarn may be textured polyester. The present invention is not so limited however, and multifilament flat yarns and monofilament could also be used in any type of material.

To avoid de-knitting an additional yarn can be employed, using an additional guide bar, to simultaneously form other chain stitches with the same needle making the chain stitches with loops (A).

The additional bar should not work with the needles making the loop piles.

With the invention it is possible to vary the number of wales of chain stitches with loops. It is also possible to vary the size of the stitches without compromising on the performance of the loops.

An advantage of the invention is that it permits increased formation speed or increased loop density in a given fabric area, thereby substantially improving the performance of the Tricot and Raschel knitting machines.

It has been found that the interlaced loop structure of the invention gives the following advantages:

(a) Loops are kept together so that there is no risk of the loops of adjacent wales bending in opposite directions away from each other, thus leaving a strip area of the fabric between the wales without loops;

(b) Right side loops are not mixed with left side loops of the same wale;

(c) The loops are well distributed between wales, given more even coverage of loops over the surface of the fabric; are (d) Each loop serves to reinforce another loop, making the loops stronger and less prone to damage.

Further modifications and improvements may be incorporated without departing from the scope of the invention herein intended.

What is claimed is:

1. A loop fabric comprising a plurality of individual wales of chain stitches, each of said chain stitches having a corresponding loop adapted to serve as the loop of said hook and loop fastening structure, wherein the wales of chain stitches are knitted on a supporting background, and wherein the loops on each wale are interlaced with the loops on each adjacent wale and adjacent loops are formed from different yarns.

2. A fabric according to claim 1, where in each wale is made of two yarns.

3. A fabric according to claim 2, wherein the background structure is a regular warp knitted fabric from a warp knitting machine.

4. A method according to claim 3, wherein the pattern wheel of the knitting machine is set such that each wale has a movement of at least 4.

5. A fabric according to claim 2, wherein the background structure is a weft insertion warp knitted fabric.

6. A fabric according to claim 2, wherein the background structure comprises a plurality of weft yarns on which the wales are knitted.

7. A fabric according to claim 2, wherein the background structure is a non-woven material or a film material.

8. A fabric according to claim 1, wherein the background structure is a regular warp knitted fabric.

9. A fabric according to claim 1, wherein the background structure is a weft insertion warp knitted fabric.

10. A fabric according to claim 1, wherein the background structure comprises a plurality of weft yarns on which the wales are knitted.

11. A fabric according to claim 1, wherein the background structure is a non-woven material or a film material.

12. A method for producing a loop fabric according to any one of the preceding claims 2 and 4, wherein the loops are formed using a single guide bar.

* * * * *